US012571293B2

(12) United States Patent
Feng et al.

(10) Patent No.: US 12,571,293 B2
(45) Date of Patent: Mar. 10, 2026

(54) METHOD FOR REMINING RESIDUAL COAL PILLAR IN RESIDUAL MINING AREA BY COLLABORATION OF PILLAR-SIDE BACKFILLING AND IN-SITU GASIFICATION

(71) Applicant: Taiyuan University of Technology, Taiyuan City (CN)

(72) Inventors: Guorui Feng, Taiyuan City (CN); Jian Li, Taiyuan City (CN); Jinwen Bai, Taiyuan City (CN); Jun Guo, Taiyuan City (CN); Junbiao Ma, Taiyuan City (CN); Xudong Shi, Taiyuan City (CN)

(73) Assignee: TAIYUAN UNIVERSITY OF TECHNOLOGY, Taiyuan City (CN)

( * ) Notice: Subject to any disclaimer, the term of this patent is extended or adjusted under 35 U.S.C. 154(b) by 336 days.

(21) Appl. No.: 18/364,720

(22) Filed: Aug. 3, 2023

(65) Prior Publication Data

US 2024/0301782 A1 Sep. 12, 2024

(30) Foreign Application Priority Data

Mar. 7, 2023 (CN) ..... 202310222693.8

(51) Int. Cl.
*E21B 43/295* (2006.01)
*E21F 15/00* (2006.01)

(52) U.S. Cl.
CPC ..... *E21B 43/295* (2013.01); *E21F 15/00* (2013.01)

(58) Field of Classification Search
CPC ..... E21B 43/295; E21F 15/00
See application file for complete search history.

(56) References Cited

U.S. PATENT DOCUMENTS 4,087,130 A * 5/1978 Garrett ..... E21B 43/243 166/266

FOREIGN PATENT DOCUMENTS

| | | | | |
|---|---|---|---|---|
| CN | 104564011 A | | 4/2015 | |
| CN | 104832174 A | | 8/2015 | |
| CN | 108952719 A | * | 12/2018 | ..... E21C 41/18 |
| CN | 112593939 A | | 4/2021 | |
| CN | 112963196 A | | 6/2021 | |
| CN | 110030031 B | | 7/2021 | |

OTHER PUBLICATIONS

Study on Comprehensive Evaluation and Stable Production Technology for Underground Gasification of Residual Coal. China Academic Journal Electronic Publishing House, 1994-2022, http://111.cnki.net.

(Continued)

*Primary Examiner* — Janine M Kreck
(74) *Attorney, Agent, or Firm* — Volpe Koenig

(57) ABSTRACT

Disclosed is a method for remining a residual coal pillar in a residual mining area by collaboration of pillar-side backfilling and in-situ gasification. The method includes the following steps of: ascertaining geological and hydrological conditions, a geometric shape and a reserve of a residual coal pillar; carrying out side supporting on the residual coal pillar in a goaf by using a pillar-side backfilling method; and carrying out the underground gasification mining on the residual coal pillar by means of an underground coal gasification process.

7 Claims, 4 Drawing Sheets

(56) References Cited

OTHER PUBLICATIONS

Office Action issued in corresponding Chinese Patent Application No. 202310222693.8 on Mar. 29, 2025, consisting of 14 pp. (English Translation Provided).
Chen, Jianxiang, "The Coal Kingdom", Edited by Pang Qi, Popular Science Press, Dec. 2021, p. 73, Science Popularization Series on Low-Carbon and Clean Energy. ISBN 978-7-110-10407-1. (English Translation of p. 73 Provided).

* cited by examiner

METHOD FOR REMINING RESIDUAL COAL PILLAR IN RESIDUAL MINING AREA BY COLLABORATION OF PILLAR-SIDE BACKFILLING AND IN-SITU GASIFICATION

CROSS-REFERENCE TO RELATED APPLICATION

This patent application claims the benefit and priority of Chinese Patent Application No. 2023102226938 filed with the China National Intellectual Property Administration on Mar. 7, 2023, the disclosure of which is incorporated by reference herein in its entirety as part of the present application.

TECHNICAL FIELD

The present disclosure relates to the technical field of coal mining, and in particular to a method for remining a residual coal pillar in a residual mining area by collaboration of pillar-side backfilling and in-situ gasification.

BACKGROUND

China is the largest coal producer and consumer in the world, and has a long history of coal mining. However, due to the backward mining technology in the early days, the recovery rate of the mining is low and the coal is not fully utilized, resulting in some coal resources left behind in the mining process. These left coal resources include a large number of residual coal pillars to support the goaf and have extremely high remining value. However, due to the scattered occurrence positions of these residual coal pillars and the complex geological environment, it is difficult to remine the residual coal pillars, and the economic benefits of mining are poor. Meanwhile, as these residual coal pillars have existed underground for a long time, the presence of large amounts of mashgas in the surrounding residual mining area makes it difficult for production personnel and equipment to access. Moreover, the residual coal pillars and floating coal in the goaf are more prone to spontaneous combustion, which leads to high mining risk and no guarantee of the safety. The existing methods for remining the residual coal pillars mainly include: a drainage method, a pillar cutting method, artificial pillar replacement, full backfilling delayed stopping, stopping by a caving method, etc. A method combining backfilling with a hydraulic support is used in Chinese Patent Publication No. CN112593939A to replace and mine a full coal pillar. It is proposed in Chinese Patent Publication No. CN112963196A to perform supporting in a transport roadway, an air-return roadway and a crosshead-ing, and to backfill a formed roadway between the pillars to mine a protective coal pillar between the roadways. In Chinese Patent Publication No. CN110030031B, it is proposed that a residual mining area should be backfilled first, and then a longwall working face should be arranged for the stopping of a residual coal pillar. However, the above mining methods for the residual coal pillar should not only ensure the stability of the overlying rock of the roof of the roadway, but also ensure the safety of personnel and equipment. Meanwhile, due to the use of more equipment, the stopping process is complicated, the operation is complicated and the mining cost is high. Therefore, it is necessary to design a mining process different from the traditional physical mining to remine the residual coal pillars, so as to improve the utilization rate of coal resources.

Underground coal gasification technology is a chemical mining method that gasifies coal resources into combustible gas in situ and exhausts the same, which does not need the personnel to enter the downhole for operation. And, this chemical mining method has the advantages of high safety, environmental friendliness and high mining efficiency. At present, the existing industrial tests and technologies of underground coal gasification in China are mainly aimed at the full-seam residual coal, hard-mining coal, coal under building, water and villages, and other residual coal resources. And, there are few studies on underground gasification mining of residual coal pillars in residual mining areas. Meanwhile, high temperature produced in the gasification process may lead to thermal fracture and thermal expansion of isolated coal pillars and roof and floor rock strata, which affects the physical and mechanical properties of coal and rock mass, and in severe cases, may cause roof caving in a combustion space area, gas leakage in the gasifier and even surface deformation and subsidence. To this end, it is urgent to find out a method to reinforce the stability of a goaf for gasification mining of an isolated coal pillar, so as to effectively solve the problem of roof caving caused by high temperature in the gasification process and ensure the safety and stability of gasification mining of the isolated coal pillar.

SUMMARY

Aiming at the problem of insufficient safety and stability in the mining process of a residual coal pillar in a residual mining area, a method for remining a residual coal pillar in a residual mining area by collaboration of pillar-side backfilling and in-situ gasification is provided. In accordance with the method, a comprehensive mining system for gasifying coal is formed by constructing a pillar-side backfilling facility on the ground and an underground gasification device, which can achieve the complete mining of the residual coal pillar, has good economic benefits, high safety and high mining efficiency. Therefore, the stability of a roof in the residual mining area is ensured, residual coal resources can be fully mined, the probability of mine fire caused by coal spontaneous combustion is reduced, and the waste of coal resources is reduced.

To achieve the objective above, some embodiments provide the following technical solution.

A method for remining a residual coal pillar in a residual mining area by collaboration of pillar-side backfilling and in-situ gasification, comprising following steps of: ascertaining geological and hydrological conditions, a geometric shape and a reserve of the residual coal pillar; determining feasibility of underground gasification mining of the residual coal pillar; carrying out side supporting on the residual coal pillar in a goaf by using the pillar-side backfilling; and carrying out underground gasification mining on the residual coal pillar by means of an underground coal gasification process. The method specifically includes the following steps:

- step 1: determining feasibility of the underground gasification mining of the residual coal pillar in the residual mining area;
- step 2: drawing a distribution pattern map of the residual coal pillar in the residual mining area;
- step 3: arranging a gas inlet pipeline and an exhaust pipeline in a pillar mining area beside the residual coal pillar, wherein one end of the gas inlet pipeline is arranged in the residual coal pillar, an other end of the gas inlet pipeline is connected to a gas pump on ground, one end of the exhaust pipeline is arranged in the residual coal pillar, and an other end of the exhaust pipeline is connected to a diffusing tower and a gas collection device on the ground;

step 4: arranging a backfilling pipeline in the pillar mining area beside the residual coal pillar, wherein one end of the backfilling pipeline is arranged in the pillar mining area or connected to the gas inlet pipeline, and an other end of the backfilling pipeline is connected to backfilling equipment on the ground;

step 5: injecting a backfilling material uniformly into the pillar mining area at both sides of the residual coal pillar under an action of the backfilling equipment so as to form a pillar-side backfill body;

step 6: heating the residual coal pillar by an ignition device at the one end of the gas inlet pipeline, continuously introducing a gasifying agent into the residual coal pillar by using the gas pump on the ground, enabling coal of the residual coal pillar to start burning and continuing a gasification reaction; and exhausting a combustible gas generated by the gasification reaction to the diffusing tower and the gas collection device on the ground through the exhaust pipeline until the residual coal pillar is completely gasified;

step 7: after the gasification reaction of the residual coal pillar is completed, repeating step 3 to step 6, continuing to carry out the pillar-side backfilling and the in-situ gasification on a next residual coal pillar which is adjacent to the completely gasified residual coal pillar in the residual mining area, and carrying out the underground gasification mining on remaining residual coal pillars in the mining area step by step.

Preferably, the residual coal pillar in the residual mining area has a thickness of greater than 2 m and a buried depth of greater than 300 m.

Preferably, the pillar mining area has a width from 20 m to 160 m.

Preferably, the backfilling equipment comprises a backfilling pump, a blender, a mixer, a storage device, a charger, a feeding rack, a slurry producing machine, and a slurry filter and a loader; and the gas pump on the ground comprises an air pump, an oxygen pump, a water vapor pump, and a carbon dioxide pump.

Preferably, the backfill body comprises following raw materials in weight percentage: 15%-30% of cement, 10%-20% of coal ash, 10%-20% of water, 55%-65% of sand/building debris, and 1%-3% of water reducer.

Preferably, the backfill body is backfilled by using a backfilling method for pillar-side bilateral parts disclosed in Chinese Patent Publication No. CN104832174A.

Preferably, the gasifying agent comprises air, oxygen, water vapor, and carbon dioxide. The composition of the gasifying agent can be adjusted according to a high-temperature coal gas required for production.

Preferably, the temperature generated by the ignition device is from 600° C. to 1,500° C.

Preferably, an outer side of the residual coal pillar is further provided with an electron temperature sensor.

Compared with the prior art, some embodiments have the following beneficial effects.

(1) Compared with the traditional method for mining a residual coal pillar, a mining process of firstly performing ground pillar-side backfilling and then performing underground in-situ gasification is provided in accordance with an embodiment of the present disclosure. The adopted chemical mining mode is good in safety, low in cost, and good in economic benefit. Moreover, the pollutants produced after gasification can be left in situ underground, and thus both the pollution and the damage to the environment are reduced.

(2) Compared with the general method for underground gasification of full-seam residual coal, the underground gasification technology according to an embodiment of the present disclosure is applied to the field of remining residual coal pillars, which fully utilizes the residual coal pillar resources in the residual mining area and greatly reduces the waste of coal resources. Moreover, the technology of backfilling first and gasifying later also greatly enhances the stability of a surrounding rock of a gasification channel during the gasification process.

(3) According to an embodiment of the present disclosure, backfilling and gasification systems are combined together, and the backfilling and gasification processes can be well connected, which leads to the simple step, the low gasification difficulty and the less labor required.

(4) The pillar-side backfill body can ensure the airtightness of a gasifier, plug fractures formed in the surrounding rock, prevent the combustible gas produced by gasification from leaking, and ensure the stable progress of gasification process. Meanwhile, the pollutants produced by coal combustion are locked and prevented from seeping into groundwater.

(5) The backfill body wrapped outside the gasification pipeline can prevent the pipeline from being damaged by roof rock caving during gasification, and protect the gasification pipeline.

Figure 1:
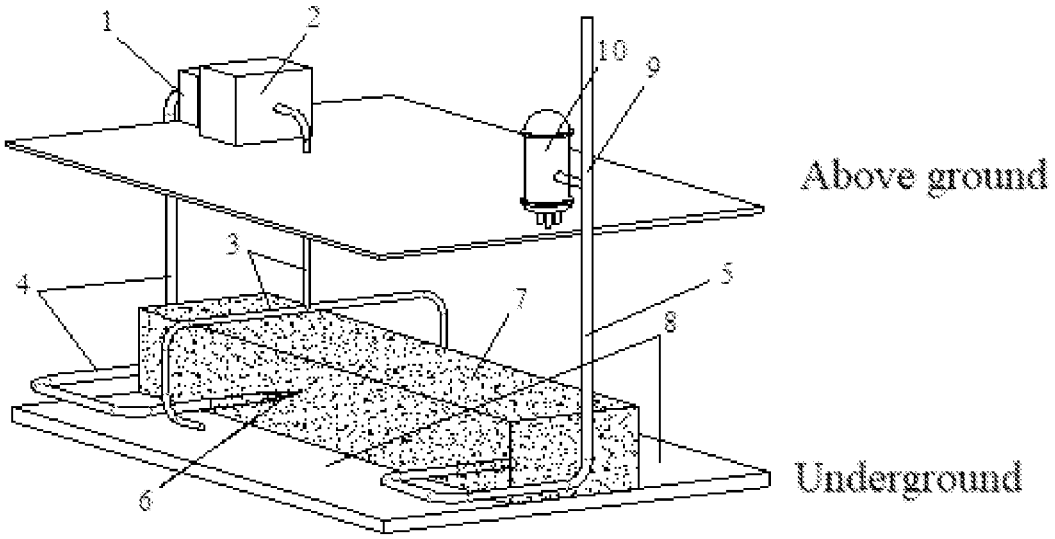
FIG. 1 is a schematic diagram of a system for remining by collaboration of pillar-side backfilling and in-situ gasification according to an embodiment of the present disclosure.
Figure 2:
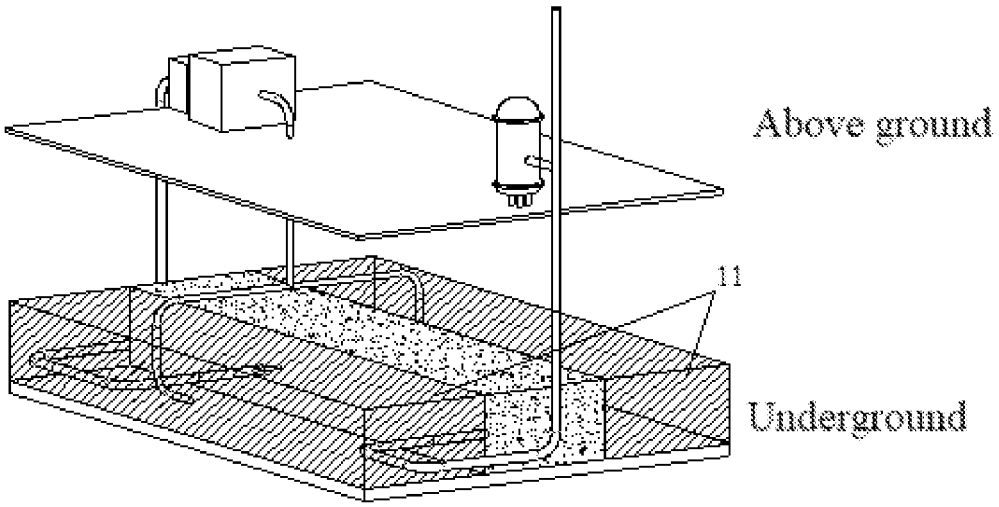
FIG. 2 is a schematic diagram of a pillar-side backfilling process for a residual coal pillar in a residual mining area according to an embodiment of the present disclosure.
Figure 3:
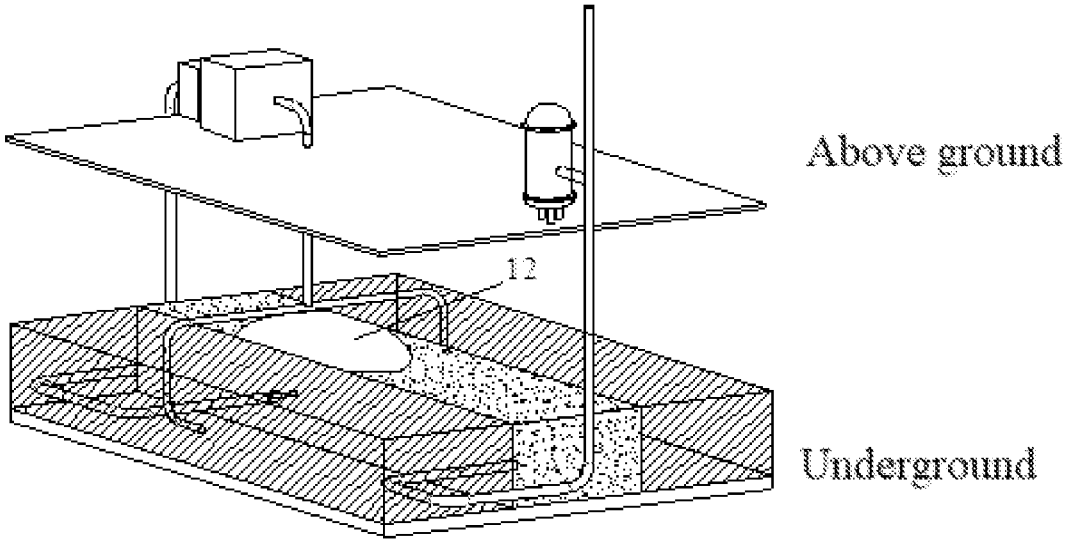
FIG. 3 is a schematic diagram of an underground gasification process for a residual coal pillar in a residual mining area according to an embodiment of the present disclosure.
Figure 4:
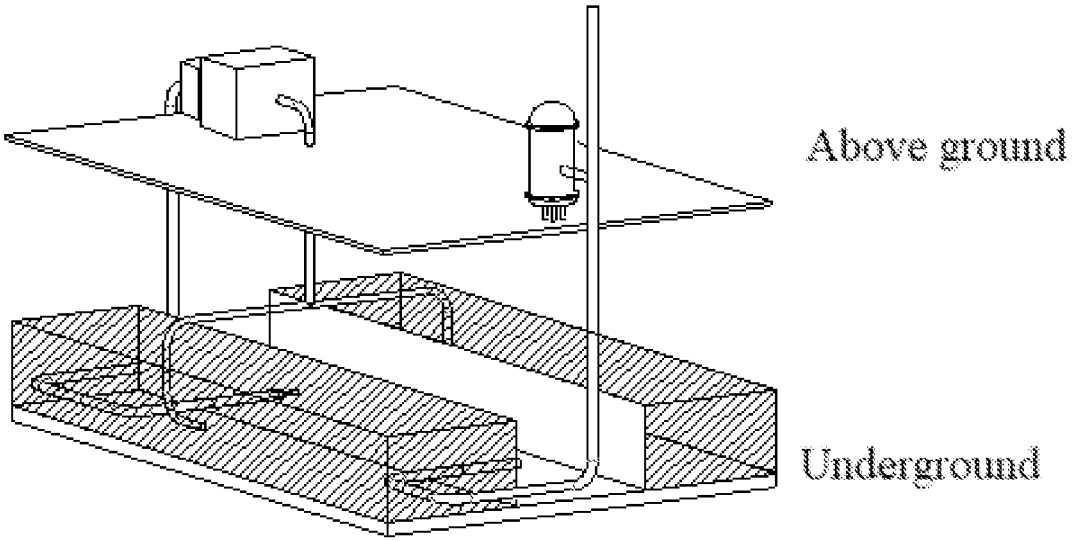
FIG. 4 is a schematic diagram of a backfill body after gasification of a residual coal pillar in a residual mining area.

In the drawings: 1 gas pump on the ground; 2 backfilling equipment; 3 backfilling pipeline; 4 gas inlet pipeline; 5 exhaust pipe; 6 ignition device; 7 residual coal pillar; 8 pillar mining area; 9 diffusing tower; 10 gas collection device; 11 pillar-side backfill body; 12 underground gasification combustion space area; 13 combined pipeline; and 14 grouting nozzle.

DETAILED DESCRIPTION OF THE EMBODIMENTS

For ease of understanding of the present disclosure, the present disclosure is described more fully below with reference to the accompanying drawings. The present disclosure may, however, be embodied in many different forms and is not limited to the embodiments described herein. Rather, these embodiments are provided for the purpose of providing a more complete and thorough understanding of the present disclosure.

Embodiment 1

As shown in FIG. 1 through FIG. 4, a method for remining a residual coal pillar in a residual mining area by collaboration of pillar-side backfilling and in-situ gasification includes the following specific steps.

In step 1, in view of original geological and hydrological data and mining history data of a mine, and the feasibility of gasification mining of a residual coal pillar 7 in a residual mining area is determined by using an underground gasification comprehensive evaluation model described in the paper Study on Comprehensive Evaluation and Stable Production Technology for Underground Gasification of Residual Coal.

In step 2, the original geological and hydrological data and technical production data of the mine are considered to find out a distribution area, height, width and length of the residual coal pillar 7 of the mine; a three-dimensional laser scanner and a mine roadway geological detector are used to ascertain the distribution of the residual coal pillar 7 and a geological structure of the residual mining area, so as to draw a distribution pattern map of the residual coal pillar 7 of the residual mining area. The residual coal pillar 7 in the residual mining area has a thickness of greater than 2 m and a buried depth of greater than 300 m, and a pillar mining area 8 has a width from 20 m to 160 m.

In step 3, a gas inlet pipeline 4 and an exhaust pipeline 5 are arranged in the pillar mining area 8 beside the residual coal pillar 7 by using a directional drilling technology. One end of the gas inlet pipeline 4 is arranged in the residual coal pillar 7, and the other end of the gas inlet pipeline 4 is connected to a gas pump 1 on the ground. One end of the exhaust pipeline 5 is arranged in the residual coal pillar 7, and the other end of the exhaust pipeline 5 is connected to a diffusing tower 9 and a gas collection device 10 on the ground. The gas pump 1 on the ground includes an air pump, an oxygen pump, a water vapor pump, and a carbon dioxide pump. The gas collection device 10 is a large gas collection tank.

In step 4, a casing drilling technology is used to carry out drilling construction from the ground position above the pillar mining area 8, so as to form the borehole with a diameter of 300 mm, an inclination angle of 10-15°, and an inclination direction consistent with a stratum thereof, and a backfilling pipeline 3 for conveying backfilling paste is arranged in the pillar mining area 8 on each of both sides of the residual coal pillar 7. One end of the backfilling pipeline 3 is arranged in the pillar mining area 8, with an end head connected to a spray pump truck, and the other end of the backfilling pipeline 3 is connected to the backfilling equipment 2 on the ground. The backfilling equipment 2 includes a backfilling pump, a blender, a mixer, a storage device, a charger, a feeding rack, a slurry producing machine, a slurry filter, or a loader.

In step 5, under the action of the backfilling equipment 2, the backfilling paste is uniformly injected into the pillar mining area 8 on both sides of the residual coal pillar 7 to form a pillar-side backfill body 11. The backfilling paste includes the following raw materials by weight percentage: 15%-30% of cement, 10%-20% of coal ash, 10%-20% of water, 55%-65% of sand/building debris, and 1%-3% of water reducer. The backfilling paste with such composition is free of instable failure after the gasification process is finished, which can stably support the roof overlying rock after high-temperature combustion, and cannot generate large fractures and crushing during gasification, so as to ensure the airtightness of the gasification channel. The backfilling paste is backfilled by a backfilling method for pillar-side bilateral parts disclosed in Chinese Patent Publication No. CN104832174A. Paragraphs [0011] and [0012] of CN104832174A disclose that in a first step of the backfilling method, holes are drilled from top to bottom on the bottom plate of the residual coal pillar and filling material conveying pipelines are provided; in a second step of the backfilling method, filling materials are prepared, and under the action of a filling pump, the prepared filling materials are evenly injected into the pillar mining area on both sides of the residual coal pillar along the conveying pipelines of the first step of the backfilling method, such that the prepared filling materials solidify and harden, and have a lateral protection effect on the residual coal pillar. The configuration volume and backfilling time of the backfilling paste and a flow rate of a flowmeter need to be determined according to the ascertained underground space of the residual mining area and the size and distribution of the residual coal pillar.

In step 6, the residual coal pillar 7 is heated by an ignition device 6 at the one end of the gas inlet pipeline 4, a gasifying agent is continuously introduced into the residual coal pillar 7 by using the gas pump 1 on the ground to make the coal start burning and continue a gasification reaction, and the produced combustible gas of the gasification reaction is exhausted to a diffusing tower 9 and a gas collection device 10 on the ground through the exhaust pipeline 5 until the residual coal pillar 7 is completely gasified. The outer side of the residual coal pillar 7 is also provided with an electron temperature sensor to detect the temperature change in the residual coal pillar, so as to obtain the progress condition of gasification reaction in the coal pillar. The start and stop of the gasification reaction can be controlled by opening/closing the ignition device and turning on/off the gas pump. The gasifying agent includes air, oxygen, water vapor, and carbon dioxide, and the composition of the gasification agent can be adjusted according to a high-temperature coal gas required for production. The temperature produced by the ignition device 6 is from 600° C. to 1,500° C.

In step 7, after the gasification of the residual coal pillar 7 is completed, step 3 to step 6 are repeated to continue pillar-side backfilling and in-situ gasification on a next residual coal pillar 7 which is adjacent to the completely gasified residual coal pillar in the residual mining area, and the remaining residual coal pillars in the mining area are subjected to gasification mining step by step.

Embodiment 2

Figure 5:
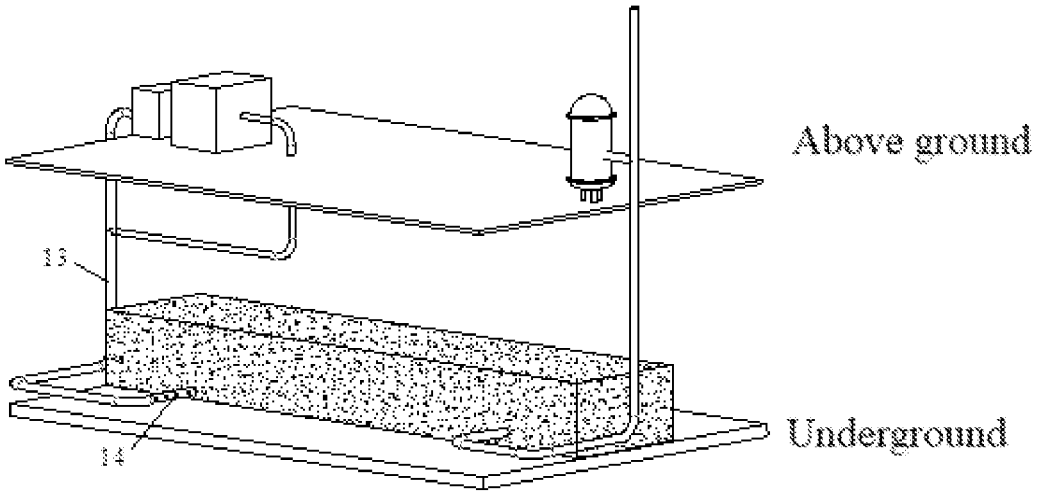
FIG. 5 is a schematic diagram of a method of combining a backfilling pipeline and a gas inlet pipeline.
Figure 6:
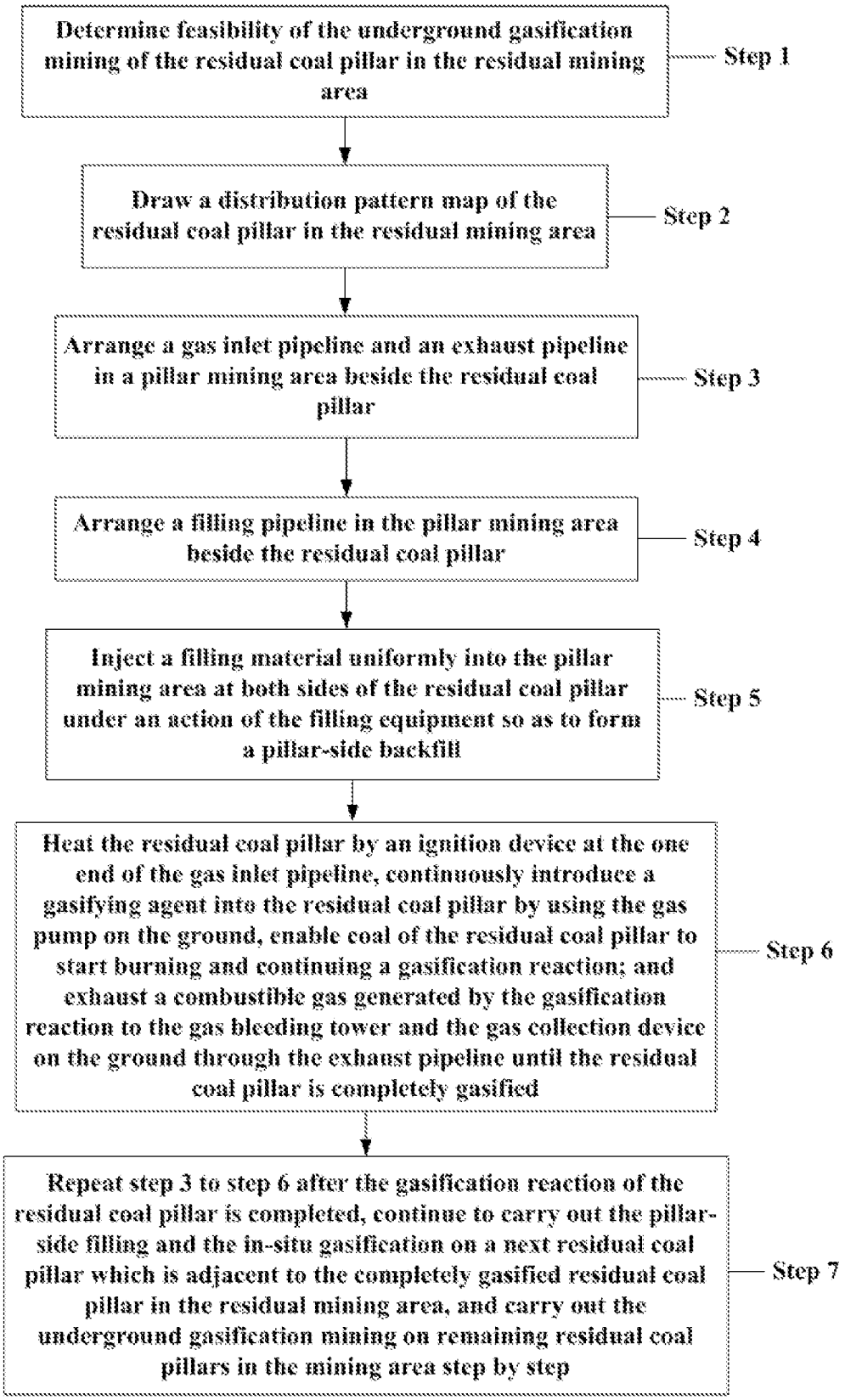
FIG. 6 is schematic flowchart of a method for remining a residual coal pillar in a residual mining area by collaboration of pillar-side backfilling and in-situ gasification according to an embodiment of the present disclosure.

The difference of the Embodiment 2 from the Embodiment 1 is that, as shown in FIG. 5, in the step 4, one end of the backfilling pipe 3 is connected to the gas inlet pipeline 4 to form a combined pipeline 13, and a portion, in the pillar mining area 8, of the combined pipeline 13 is provided with multiple grouting nozzles 14. In the step 5, the backfilling paste is replaced with backfilling slurry to prevent blocking the combined pipeline 13. An operation process of backfilling and gasification in the Embodiment 2 is as follows. Firstly, a switch of the backfilling pipeline 3 is turned on, the grouting nozzles of the combined pipeline 13 are opened, and an inlet of the gas inlet pipeline 4 and an outlet, which is arranged in the residual coal pillar, of the combined pipeline 13 are closed for the operation process of backfilling. After the operation process of backfilling is finished, the grouting nozzles 14 of the combined pipeline 13 are closed. After the backfilling slurry is solidified and hardened, the gas pump 1 on the ground is turned on, and the outlet, which is arranged in the residual coal pillar, of the combined pipeline 13 is opened to perform the operation process of gasification for the underground coal.

The method is simple in operation, by combining the backfilling pipeline and the gas inlet pipeline. So, the required equipment is less, and the cost is lower.

The foregoing embodiments are preferred embodiments of the present disclosure. It should be noted that any variations and modifications made to the process above without departing from the technical essence and principle of the present disclosure fall within the scope of protection of the present disclosure.

What is claimed is:

1. A method for remining a residual coal pillar in a residual mining area by collaboration of pillar-side backfilling and in-situ gasification, comprising following steps of:

ascertaining geological and hydrological conditions, a geometric shape and a reserve of the residual coal pillar;

carrying out side supporting on the residual coal pillar in a goaf by using the pillar-side backfilling; and carrying out underground gasification mining on the residual coal pillar by means of an underground coal gasification process.

2. The method for remining a residual coal pillar in a residual mining area by collaboration of pillar-side backfilling and in-situ gasification according to claim 1, comprising:

drawing a distribution pattern map of the residual coal pillar in the residual mining area;

arranging:

a gas inlet pipeline and an exhaust pipeline in a pillar mining area beside the residual coal pillar, wherein one end of the gas inlet pipeline is arranged in the residual coal pillar, an other end of the gas inlet pipeline is connected to a gas pump on ground, one end of the exhaust pipeline is arranged in the residual coal pillar, and an other end of the exhaust pipeline is connected to a diffusing tower and a gas collection device on the ground; and a backfilling pipeline in the pillar mining area beside the residual coal pillar, wherein one end of the backfilling pipeline is arranged in the pillar mining area or connected to the gas inlet pipeline, and an other end of the backfilling pipeline is connected to backfilling equipment on the ground;

injecting a backfilling material uniformly into the pillar mining area at both sides of the residual coal pillar under an action of the backfilling equipment so as to form a pillar-side backfill body;

heating the residual coal pillar by an ignition device at the one end of the gas inlet pipeline, continuously introducing a gasifying agent into the residual coal pillar by using the gas pump on the ground, enabling coal of the residual coal pillar to start burning and continuing a gasification reaction; and exhausting a combustible gas generated by the gasification reaction to the diffusing tower and the gas collection device on the ground through the exhaust pipeline until the residual coal pillar is completely gasified;

after the gasification reaction of the residual coal pillar is completed, repeating the arranging, injecting and heating, continuing to carry out the pillar-side backfilling and the in-situ gasification on a next residual coal pillar which is adjacent to the completely gasified residual coal pillar in the residual mining area, and carrying out the underground gasification mining on remaining residual coal pillars in the mining area step by step.

3. The method for remining a residual coal pillar in a residual mining area by collaboration of pillar-side backfilling and in-situ gasification according to claim 2, wherein the residual coal pillar in the residual mining area has a thickness of greater than 2 m and a buried depth of greater than 300 m.

4. The method for remining a residual coal pillar in a residual mining area by collaboration of pillar-side backfilling and in-situ gasification according to claim 2, wherein the pillar mining area has a width from 20 m to 160 m.

5. The method for remining a residual coal pillar in a residual mining area by collaboration of pillar-side backfilling and in-situ gasification according to claim 2, wherein the backfill body comprises following raw materials in weight percentage: 15%-30% of cement, 10%-20% of coal ash, 10%-20% of water, 55%-65% of sand/building debris, and 1%-3% of water reducer.

6. The method for remining a residual coal pillar in a residual mining area by collaboration of pillar-side backfilling and in-situ gasification according to claim 2, wherein the gasifying agent comprises air, oxygen, water vapor, and carbon dioxide.

7. The method for remining a residual coal pillar in a residual mining area by collaboration of pillar-side backfilling and in-situ gasification according to claim 2, wherein a temperature generated by the ignition device is from 600° C. to 1,500° C.

* * * * *